US006055784A

United States Patent [19]

Geiger

[11] Patent Number: 6,055,784

[45] **Date of Patent: *May 2, 2000**

[54] CONCRETE PAVING BLOCK

[76] Inventor: Peter Geiger, Regensburger Str. 160, D-92318 Neumarkt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,540

[22] PCT Filed: Aug. 2, 1996

[86] PCT No.: PCT/EP96/03405

§ 371 Date: Apr. 18, 1997

§ 102(e) Date: Apr. 18, 1997

[87] PCT Pub. No.: WO97/08389

PCT Pub. Date: Mar. 6, 1997

[30] Foreign Application Priority Data

Aug. 26, 1995 [EP] European Pat. Off. ..... 95113411

[51] Int. Cl.[7] ..... E04B 5/48

[52] U.S. Cl. ..... 52/302.1; 52/592.1; 52/605; 52/603; 404/36; 404/38

[58] Field of Search ..... 52/603, 610, 601, 52/583.1, 590.2, 591.9, 392, 302.4, 591.2, 592.1, 592.4, 604, 605; 404/34, 37, 38, 39, 41, 42, 36

[56] References Cited

U.S. PATENT DOCUMENTS

| | | | |
|---|---|---|---|
| 1,089,507 | 3/1914 | Smith | 52/610 |
| 1,694,665 | 12/1928 | Parker | 52/603 |
| 2,181,451 | 11/1939 | Dow | 52/591.2 |
| 2,207,454 | 7/1940 | Brierly | 52/392 |
| 4,792,257 | 12/1988 | Rinninger | 52/392 X |
| 5,348,417 | 9/1994 | Scheiwiller | 404/41 |
| 5,438,809 | 8/1995 | Ehrlich | 52/392 X |
| 5,496,129 | 3/1996 | Dube | 52/610 |
| 5,503,498 | 4/1996 | Scheiwiller | 404/34 |
| 5,797,698 | 8/1998 | Barth et al. | 404/42 X |

FOREIGN PATENT DOCUMENTS

| | | | |
|---|---|---|---|
| 555223 | 1/1957 | Italy | 52/302.4 |
| 555223 | 9/1958 | Italy | 52/610 |

*Primary Examiner*—Carl D. Friedman
*Assistant Examiner*—Phi Dieu Tran
*Attorney, Agent, or Firm*—Collard & Roe, PC

[57] ABSTRACT

To improve the flow-off of liquids from the laying pattern and mechanical laying in a concrete paving block, the ground area of the body (1) of the block has a rectangular shape formed by three squares (2, 3, 4) of equal size, the upright side surfaces of the body (1) extend evenly transversely to the ground area and each side surface of the body (1) has at least one projecting strip-like extension (5) which can be supported in the pattern with the formation of seams on adjacent bodies (1) and form interlocks or the like with extensions (5) of adjacent bodies (1).

8 Claims, 10 Drawing Sheets

CONCRETE PAVING BLOCK

BACKGROUND OF THE INVENTION

1. The Prior Art

Ground covering elements serving as paving blocks and having a rectangular base surface and planar side surfaces extending transversely to the rectangular base surface are known (DE-OS 2,448,312). During laying of these ground covering elements or when arranging the same in the laying packet, the ground covering elements are arranged with the side surfaces in contact with each other, resulting in a substantially closed surface which has the disadvantage of making the run-off of liquids into the ground, for example, rainwater, difficult. In addition, the non-connected ground covering elements are not suited for a mechanical laying since during the absence of sufficiently large friction forces between adjacent ground covering elements, individual ground covering elements often fall out of the laying packet.

SUMMARY OF THE INVENTION

It is an object of the present invention to improve a paving block of the above type in such a manner that after laying the same with additional paving blocks, the run-off of liquids is possible and a safe mechanical laying is provided.

According to the invention, this object is achieved in that the outer side surfaces of the body of the stone each have two strip-like attachments with a spacing "b" from each other, forming grooves with a spacing "a" between the center planes of the grooves and the nearer corner edges, and an attachment with a spacing "a" relative to the remote corner edge, whereby spacing "a" of the last-mentioned attachments corresponds with the distance of the center planes of the grooves from the first-mentioned corner edges. The faces of the body of the stone each have two attachments forming a groove with spacing "b" from each other, whereby the attachments of the faces are arranged with spacing "a" from the nearer corner edges. Furthermore the inner side surfaces of the body of the stone each have an attachment with spacing "a" from corner edges. Within the laid composite, the attachments form spacing joints relative to adjacent identical stone bodies and hook-ups with attachments of adjacent stone bodies.

Due to its geometric shape, the paving stone of the invention so created can be laid in a simple way with variations of the laying pattern and is suitable for forming laying sets which can be handled (by machines). In this connection, the paving stone jointly with other paving stones forms joints via which rainwater or the like can be drained off free from obstruction. Furthermore, by supporting the strip-like attachments on adjacent stone bodies, adequate friction grip is obtained as protection against displacement or shifting of stone bodies. For example, this grip occurs when the paving stones are subjected to vehicular traffic, whereby the "hook-ups" support safe cohesion in the course of the laying operation and in the installed or laid condition.

Additionally, while maintaining the groove-forming extensions and a single extension on the two outer longitudinal surfaces of the stone body, the inner longitudinal surfaces of the stone body are provided with one extension each as a tongue for associated grooves of adjacent stone bodies, and selectively to arrange on the end surfaces of the stone body either two extensions for forming grooves or only one extension for forming a tongue. The modifications in the paving block regarding the arrangement of grooves and tongues, which may be selected arbitrarily, make different paving patterns and an adaptation of the pavings to local conditions possible. It is also conceivable to provide the outer longitudinal surfaces of the stone body with groove-forming extensions and one single extension each, while the inner longitudinal surfaces have two extensions forming a groove or one extension serving as a tongue, and the end surfaces each have one extension or have extensions forming a groove. In an additional modification of the stone body, it is provided selectively to equip the outer longitudinal surfaces of the stone body with two extensions forming a groove and a single extension at a distance and to equip the two end surfaces as well as the inner longitudinal surfaces with one single extension as a supporting body or interlocking element.

In a further embodiment of the paving block, there is provided a prismatic stone body with a rectangular base surface and having the length of two joined squares whose one longitudinal surface and one transverse surface have two groove-forming extensions each, optionally in association with a single extension serving as a tongue, and on the opposite surface one or two individual extensions, one extension being aligned with an opposite groove, while the other extension is aligned adjacent the opposite extension. It is also conceivable in a stone body having a rectangular base surface to arrange on its longitudinal surfaces two individual extensions each serving as tongues and on its end surfaces to arrange one extension as supporting body and interlocking element. The rectangular form of the stone body allows to fill in rectangular spaces resulting from modifications during paving procedures, thus assuring supports and interlocks and a tight holding together of stone body sets. In addition, it is possible to provide a paving block having a prismatic stone body and whose base surface is square which has two extensions on adjacent side surfaces forming a groove each and which has on the opposite side surfaces one extension each. Here, one of the individual extensions is aligned with the opposite groove and the other extension is aligned as a whole adjacent the opposite extensions. Also, the square stone body may have extensions forming a groove only on one side surface and on the other side surfaces may have one single extension each in such a way that the extension opposite the groove is aligned with the groove, while the extensions of the other side surfaces are offset towards the corner areas. This assures that in pavings where square openings are formed, the openings can be closed by the square stone bodies to provide secure cohesion of the laying packet.

Further, it is provided to combine a number of stone bodies of the afore-described formations in a rectangular laying packet as a unit having outer measurements of 40×60 cm and to mechanically seize the laying packet so formed and to lay it as a unit.

It has been shown to be especially advantageous if a number of stone bodies according to the above-described embodiments form a rectangular laying packet having outer measurements of 20×40 cm, and the laying packet is capable of being combined with additional laying packets having the same measurements into a single laying packet having measurements of 40, 60, 80 and so on ×40 cm. Then these packets can be mechanically seized and laid together simultaneously. In the last-mentioned laying packets, a closed laying pattern is created in which seams are formed extending in the longitudinal direction at distances of 20 cm and in the transverse direction at distances of 40 cm.

BRIEF DESCRIPTION OF THE DRAWINGS

Other objects and features of the present invention will become apparent from the following detailed description considered in connection with the accompanying drawing which discloses embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
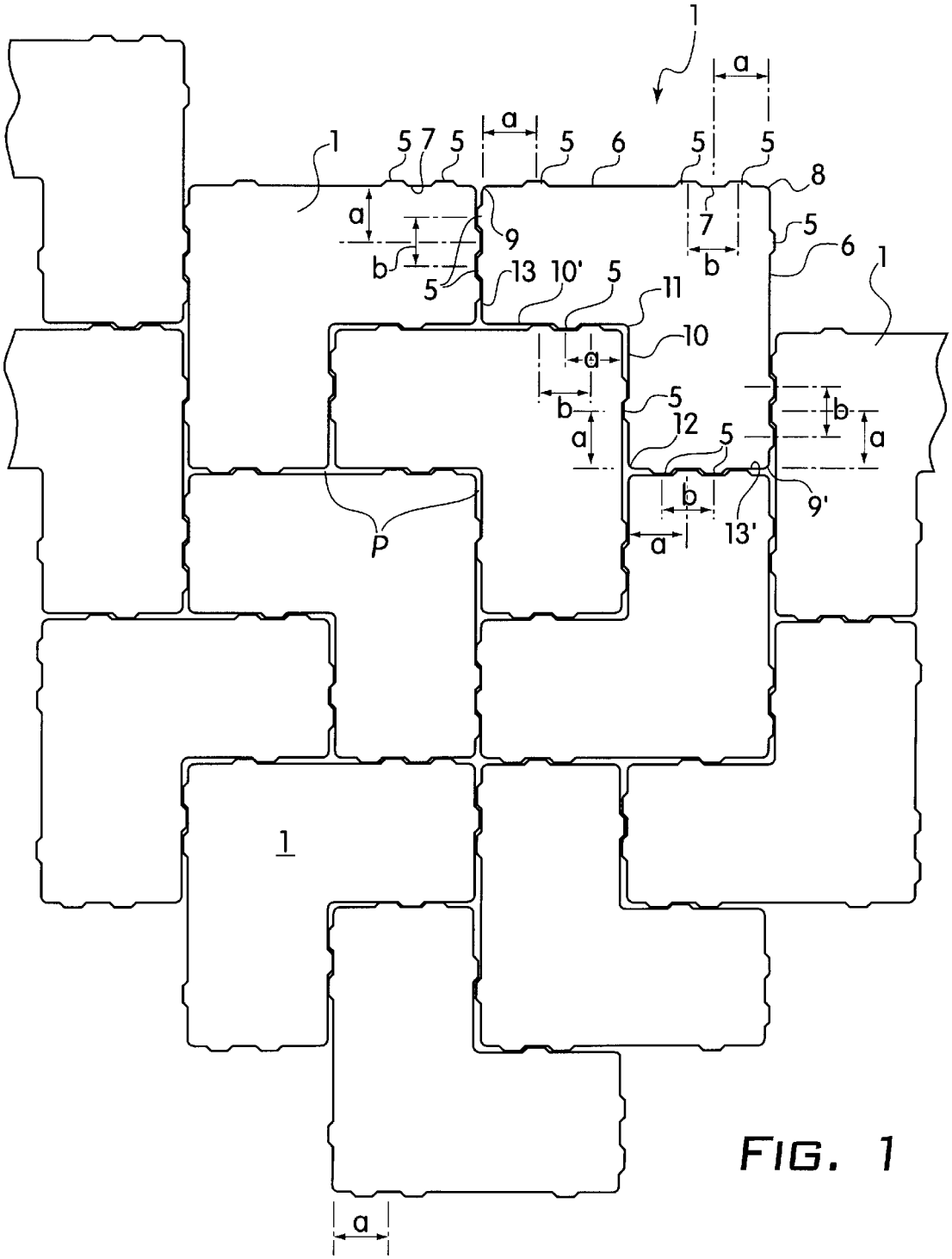
FIG. 1 shows a top view of a laying pattern with paving blocks according to an embodiment of the invention.
Figure 2:
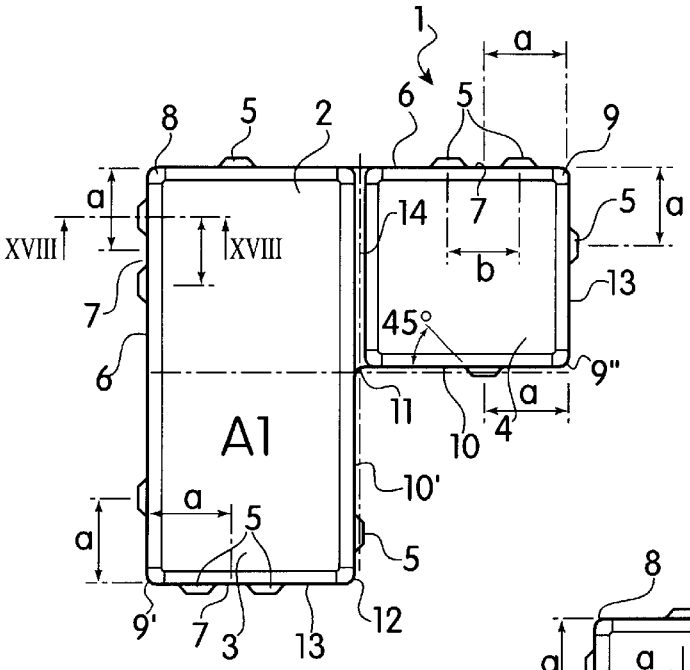
FIGS. 2 to 6 each show a top view of other embodiments of paving blocks.
Figure 3:
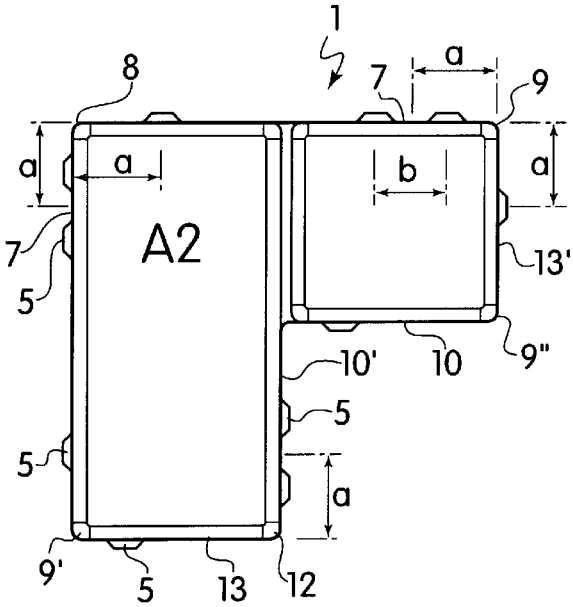
Figure 4:
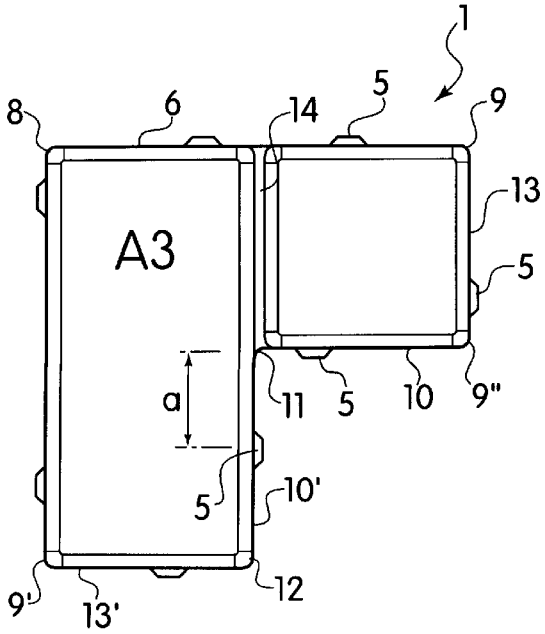
Figure 5:
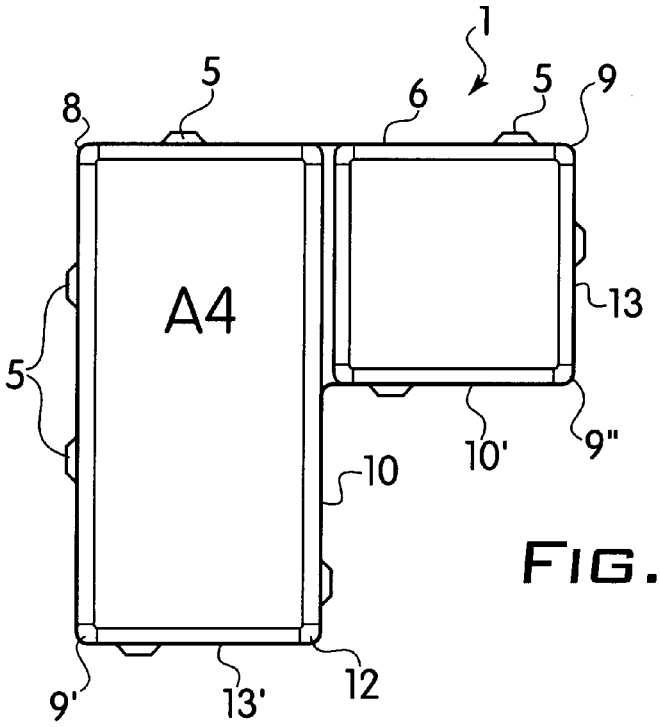
Figure 6:
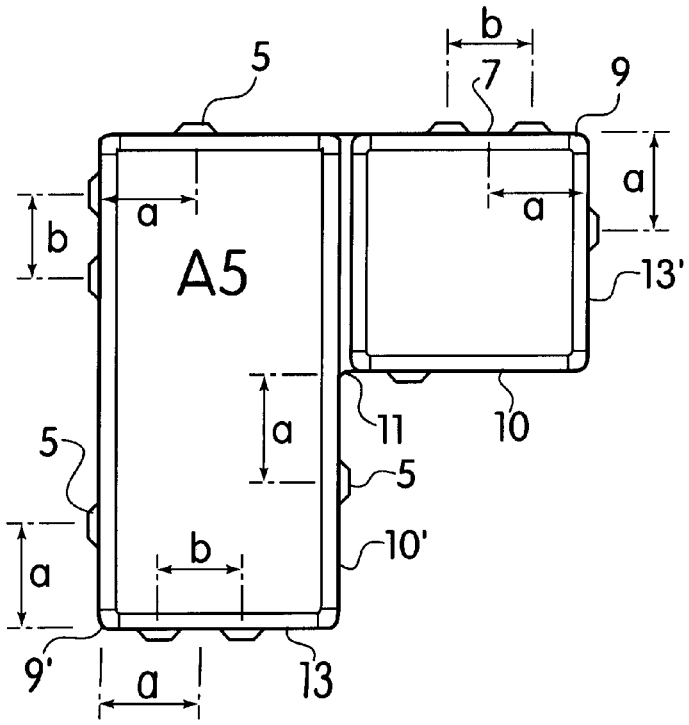
Figure 7:
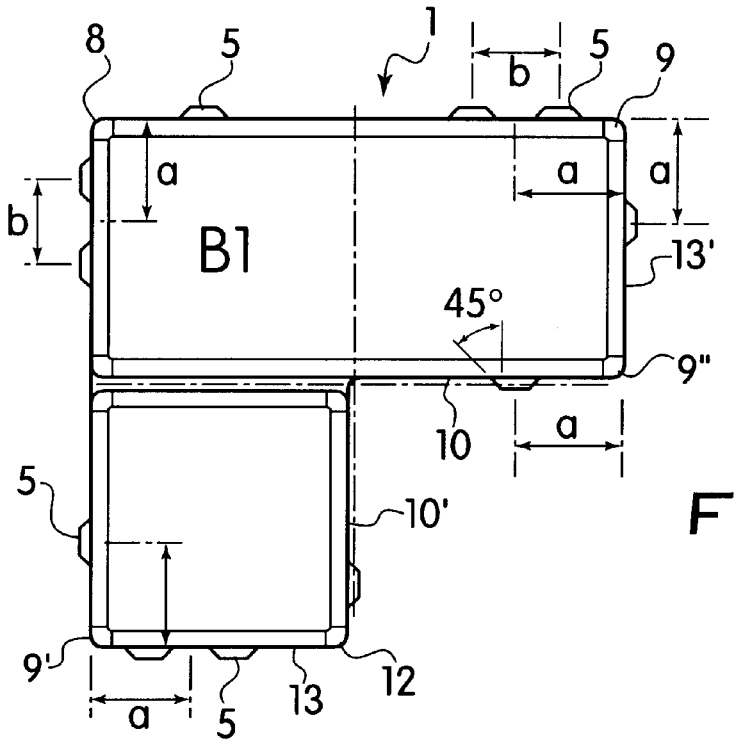
FIGS. 7 to 11 each show a top view of additional paving blocks of different embodiments.
Figure 8:
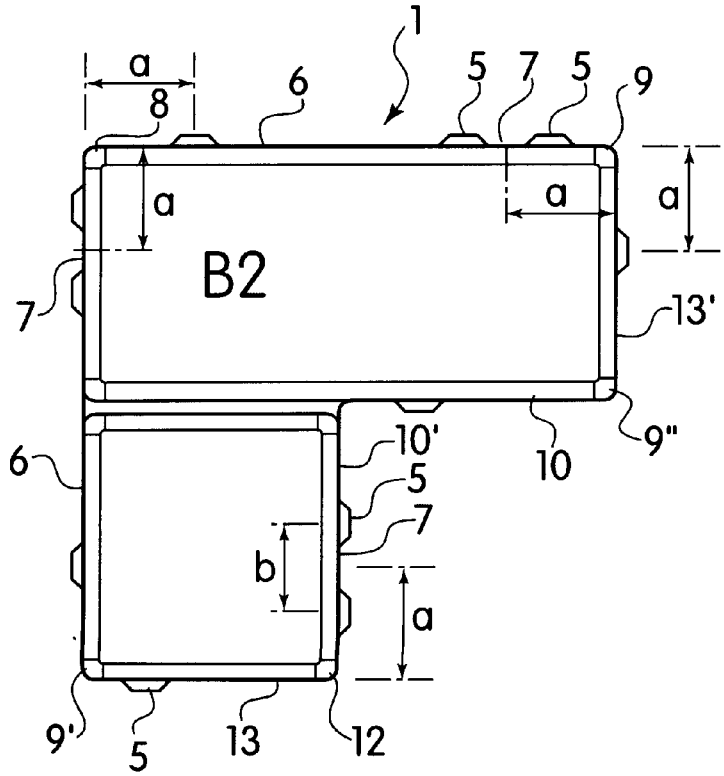
Figure 9:
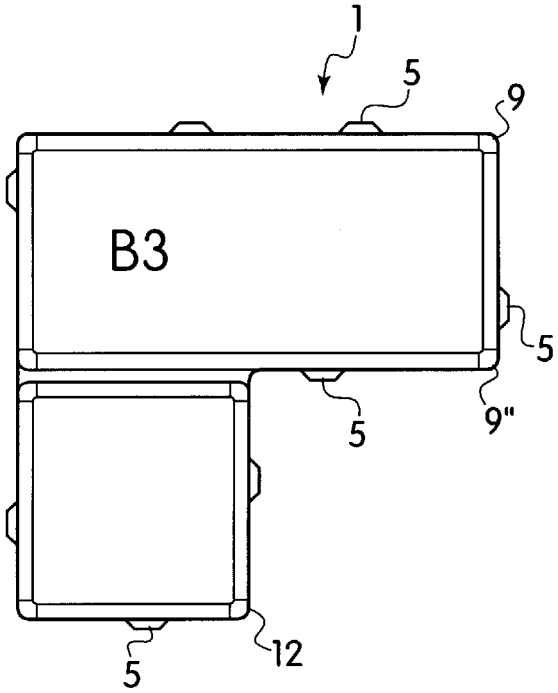
Figure 10:
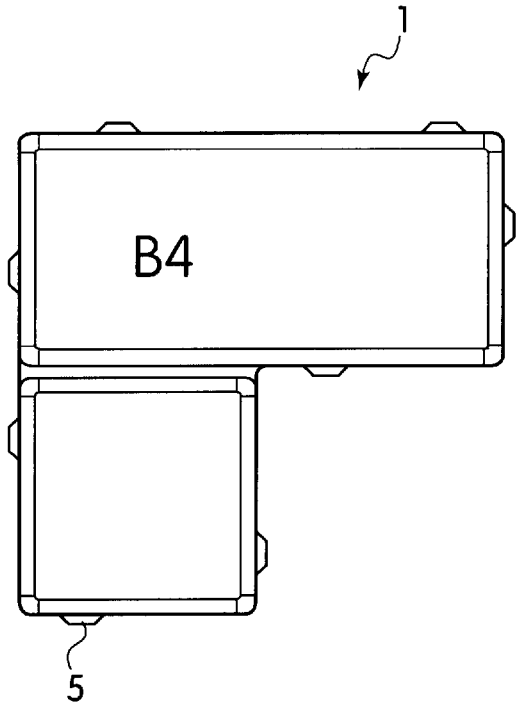
Figure 11:
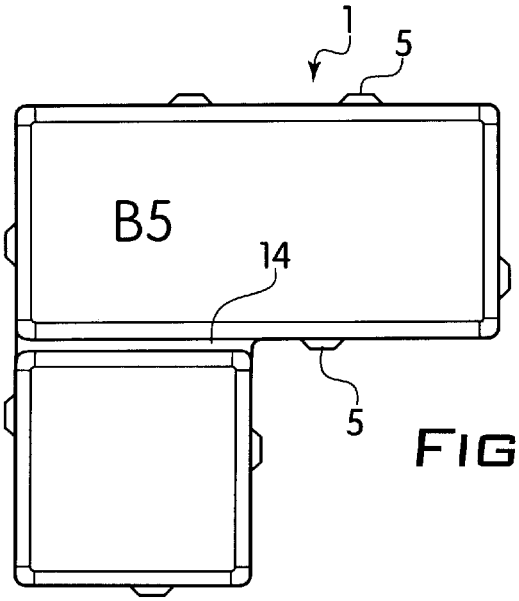
Figure 18:
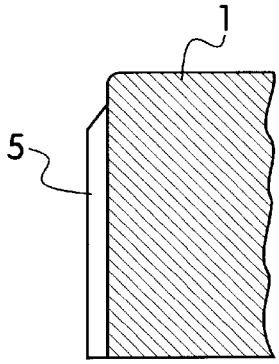
FIG. 18 shows an enlarged section view along line XVIII—XVIII of FIG. 2.

The stone body 1 of the paving block is manufactured from concrete material and has, as shown in FIG. 1, a rectangular-shaped base. The base is formed substantially by three identical squares 2, 3, and 4 attached to each other (FIG. 2). The side surfaces of stone body 1 extend transversely to the base, as especially shown in FIG. 18, and carry on the outside extensions 5 which form seams and serve as a reciprocal support of stone bodies 1 joined to each other and form interlocks with extensions 5 of adjacent stone bodies 1. Stone body of FIG. 1 shows on its outer longitudinal surfaces 6, of two extensions 5 forming a groove 7, extensions 5 being spaced at distance "b" from each other and being arranged at a distance "a" from corner edges 8, 9'. In additional, longitudinal surfaces 6 each have a single extension 5 at a distance "a" from corner edge 9 or 8. The inner longitudinal surfaces 10, 10' of stone body 1 are provided with one single extension 5 each, one of which is arranged at distance "a" from inner corner edge 11 and the other one is arranged at distance "a" from outer corner edge 12. When the stone bodies 1 are joined, extensions 5 either interlock with grooves 7 of adjacent stone bodies 1 or engage extensions 5 of the adjacent paving blocks, in order to serve, in addition as support, interlocking or the like, also to solidify the laying set. The end surfaces 13, 13' of stone body 1 always have two extensions 5 forming grooves 7, these extensions 5 together with individual extensions 5 of end surfaces 13, 13' of adjacent stone bodies 1 forming interlocks.

FIGS. 2 to 6 show paving blocks whose stone bodies 1 have modified arrangements of extensions 5. The stone bodies 1 are each again shaped rectangularly by three identical squares 2, 3 and 4. The side surfaces again extend transversely to the base surface of stone body 1 and carry extensions 5 in such a manner that the outer longitudinal surfaces 6 each have two extensions 5 forming a groove 7 and an individual extension 5. The end surfaces 13, 13' either have two extensions 5 forming a groove 7 or a single extension 5, while the inner longitudinal surfaces 10, 10' always carry one extension 5 or two extensions forming a groove and a single extension. Illusionary seams 14 are formed between the rectangular part of stone body 1 and the square part. FIGS. 2 to 6 show that extensions 5 are arranged on the stone bodies in deviations individually or together with two extensions 5 each, forming grooves 7.

In the paving blocks of FIGS. 7 to 11, stone bodies 1 are shown in a mirror-image embodiment to the stone bodies 1 of FIGS. 2 to 6. Stone bodies 1 are shaped rectangularly and also formed by three joined identical squares 2, 3, and 4. Illusionary seams 14 are formed between square part 4 and rectangular part 2, 3, of stone body 1.

Figure 12:
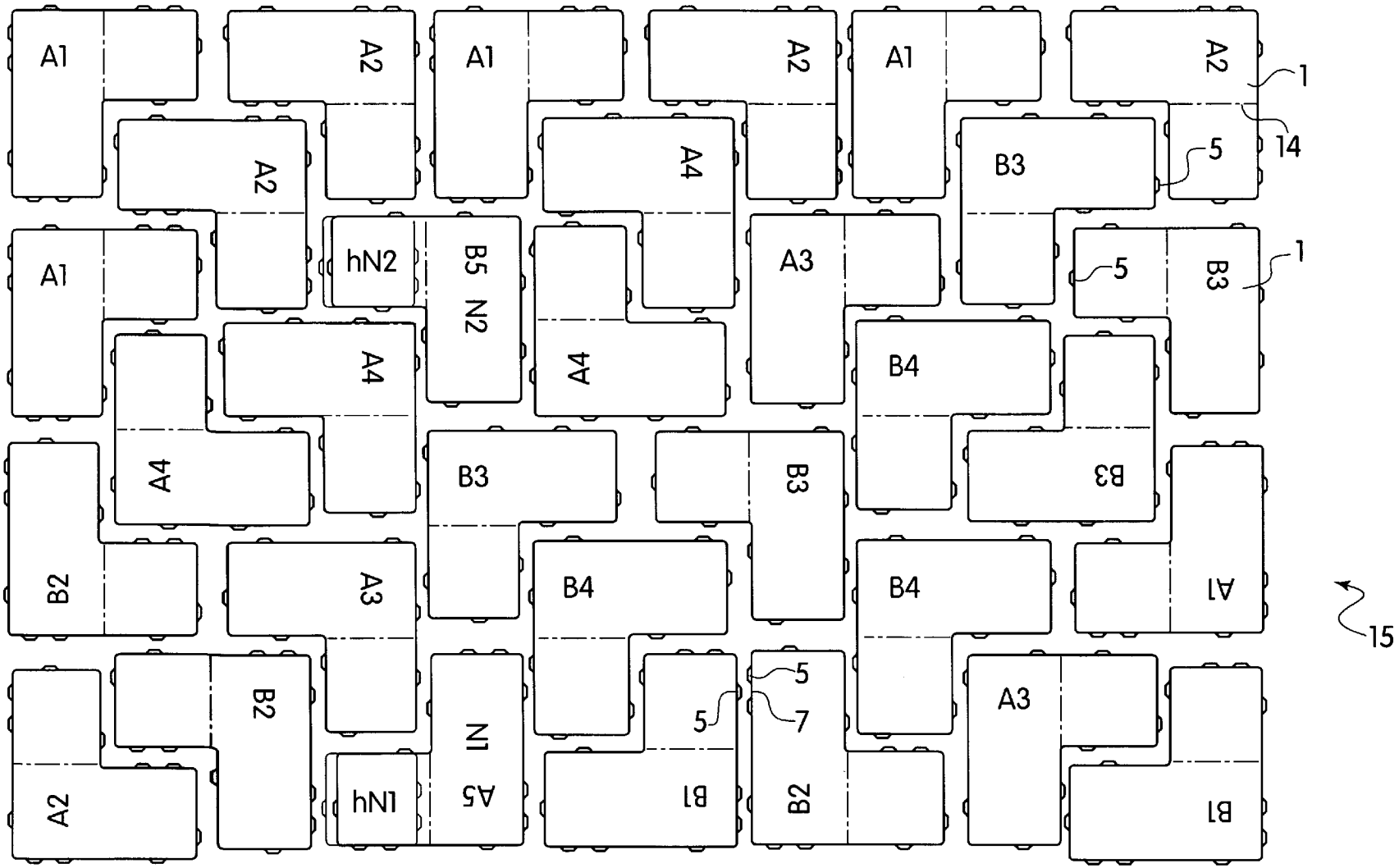
FIG. 12 shows a top view of prepared laying set.
Figure 13:
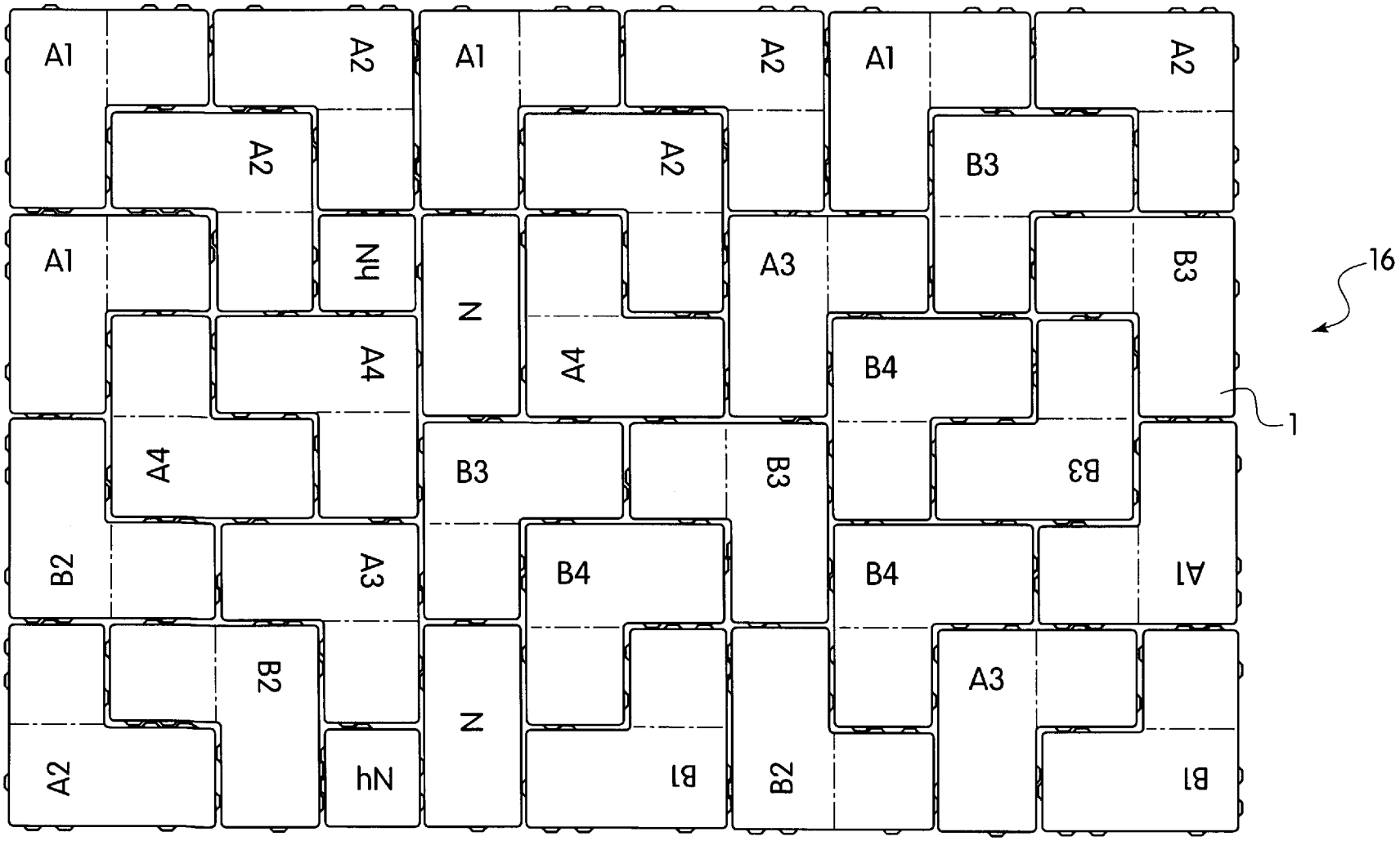
FIG. 13 shows a top view of a laying set according to FIG. 12 with the paving blocks pushed together.
Figure 19:
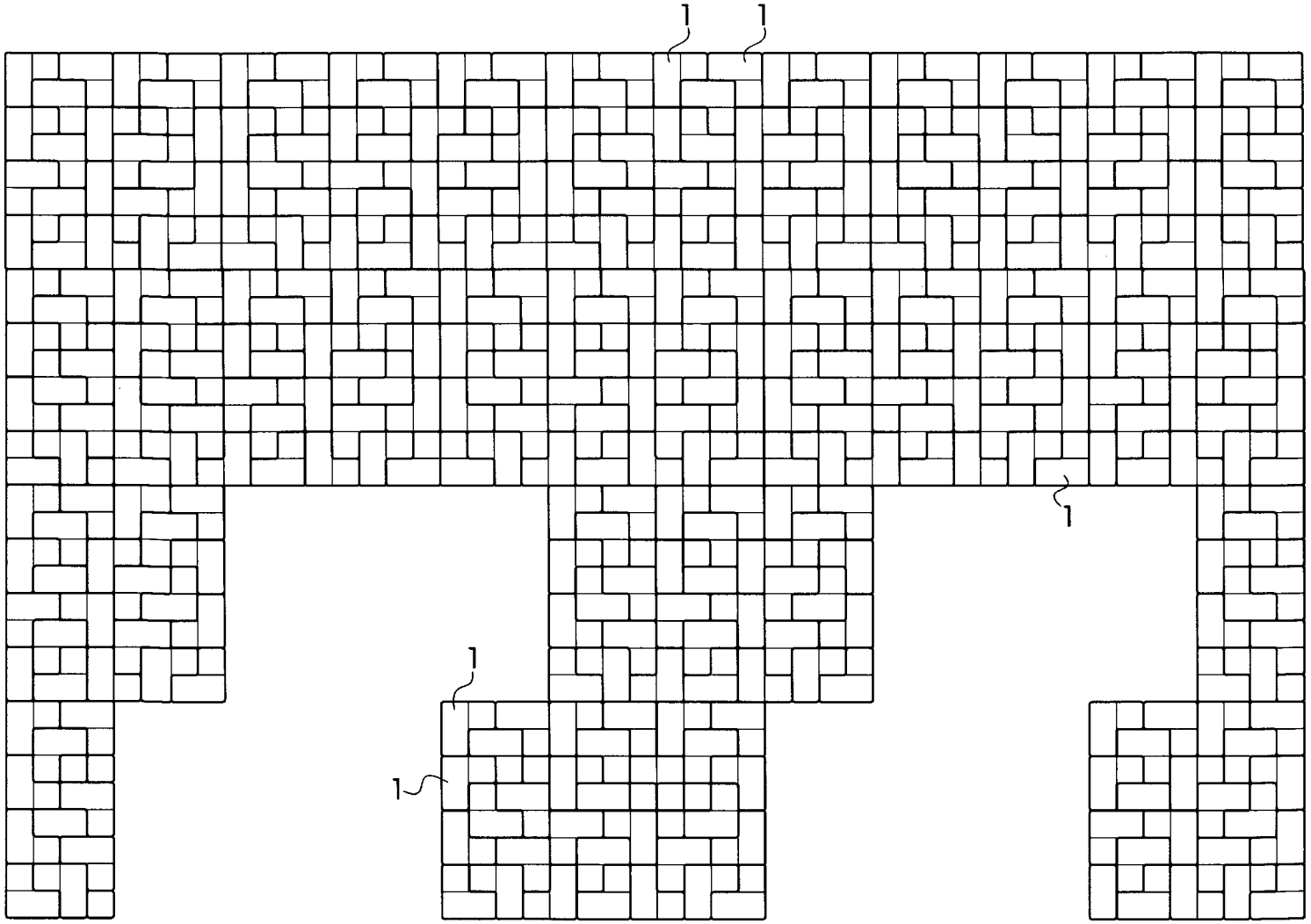
FIG. 19 shows a top view of a laying pattern of paving blocks according to FIGS. 1–18 with respect to an embodiment.

FIG. 12 shows a prepared laying set 15. It can be recognized that the stone bodies 1 of laying set 15 are spaced from each other and subsequently form a closed laying packet 16 by being pushed together in a longitudinal and transverse direction (FIG. 13). The spaced extensions 5 are utilized as supporting bodies or interlocking elements with adjacent stone bodies or extensions. In the pushed-together condition, the stone bodies 1 together form a laying packet 16 measuring 40×60 cm which is stable in itself and suitable for a secure mechanical laying according to the laying pattern of FIG. 19.

Figure 20:
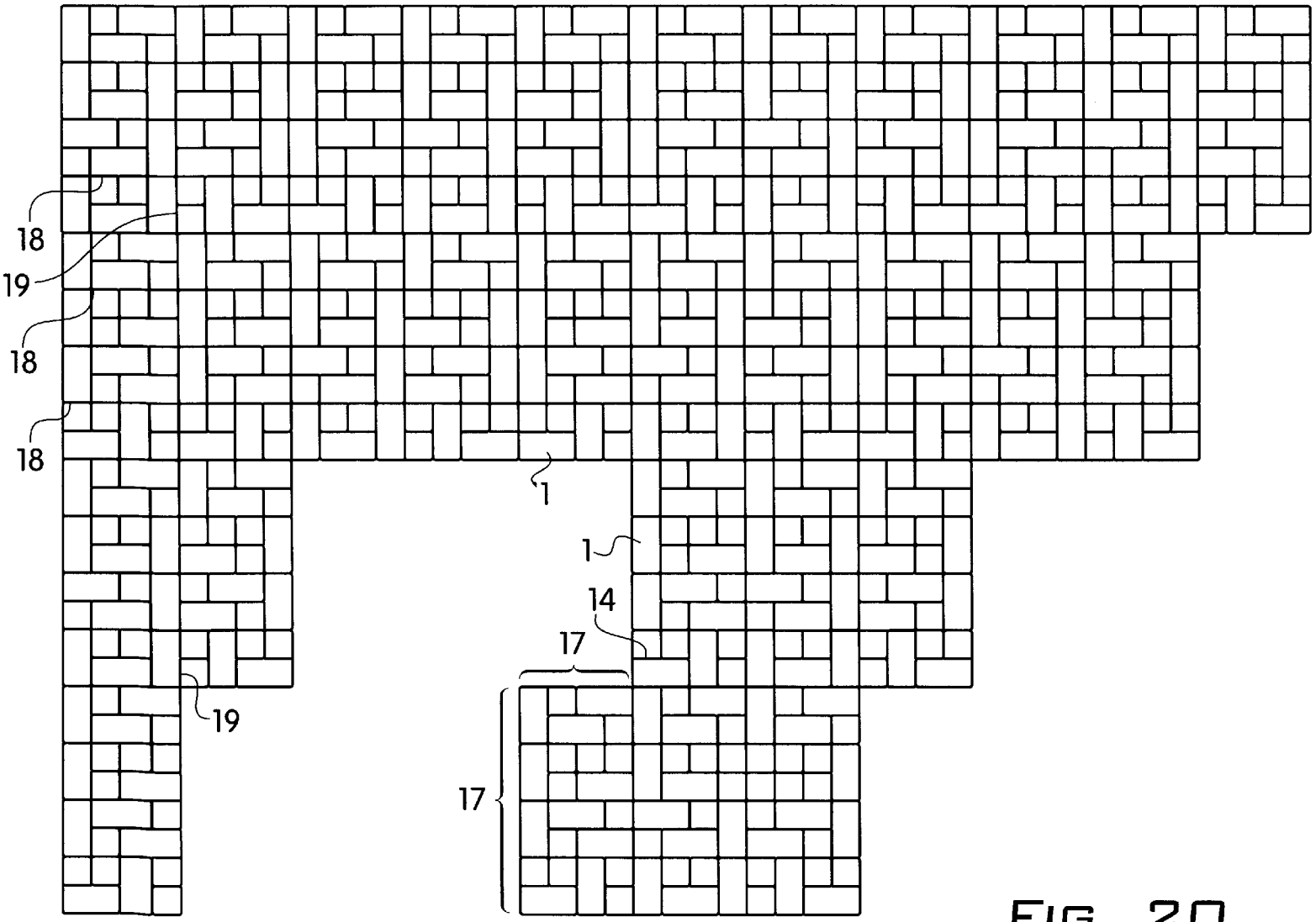
FIG. 20 shows a top view of a modified laying pattern with paving blocks of FIGS. 1–18.

Deviating therefrom, laying packets 17 having outer measurements of 20×40 cm are used in the laying pattern of FIG. 20 which, when joined with additional laying packets 17 having measurements of 20×40 cm, yield larger laying packets with the measurements 40, 60, 80 cm and so on ×20 cm, which can be seized and laid together simultaneously. The result of this is continuously extending longitudinal seams 18 and transverse seams 19, leading to an optically uniform laying pattern.

Figure 14:
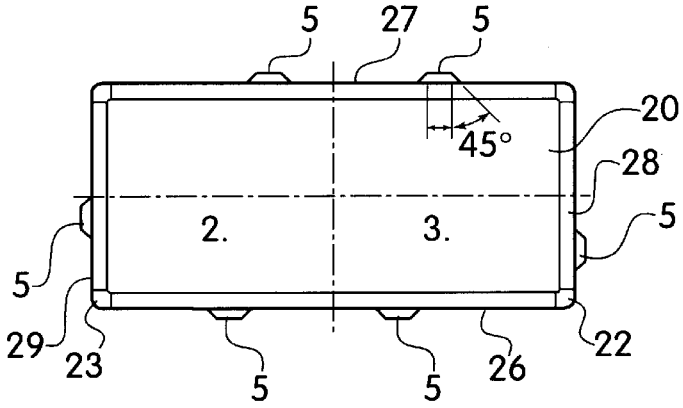
FIG. 14 shows a top view of a paving block having a different cross section.
Figure 15:
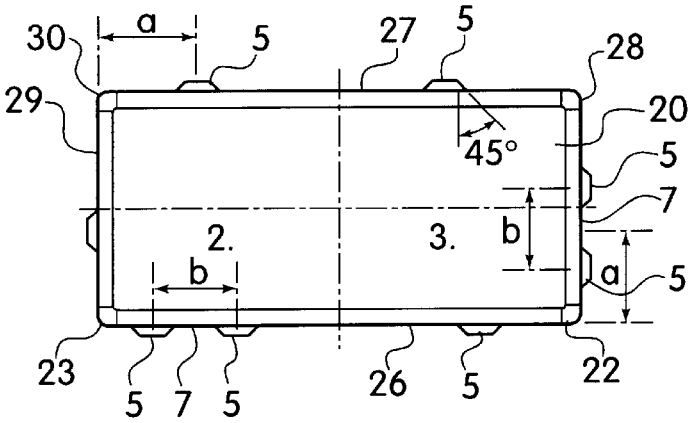
FIG. 15 shows a top view of a paving block according to FIG. 14 in a modified embodiment.

Rectangular or square gaps (not shown), which may occur during the laying of the stone bodies 1 in the laying set, may be filled with stone bodies 20 and 21 according to FIGS. 14 to 17. FIGS. 14, 15 show stone bodies 20 having a rectangular base which are formed by two identical squares 2 and 3 and have side surfaces 26, 27, 28, 29 extending transversely to the base. Extensions 5 are formed on the side surfaces of stone bodies 20 in such a way that the longitudinal surfaces 26, 27 always have two spaced individual extensions 5 and the end surfaces 28, 29 each have one individual extension 5 (FIG. 14). In contrast, stone body 20 of FIG. 15 has on one longitudinal surface 26 two extensions 5 forming a groove 7 and a single extension 5, on one end surface 28 two extensions 5 forming a groove 7, and on the respective opposite side surface 27 or end surface 29 a single extension 5 or two extensions 5. Of the last-named extensions 5, one each is aligned with groove 7 of the opposite end surface or longitudinal surface, while the other extension 5 of the longitudinal surface is aligned next to the single extension 5 of the opposite longitudinal surface.

Figure 16:
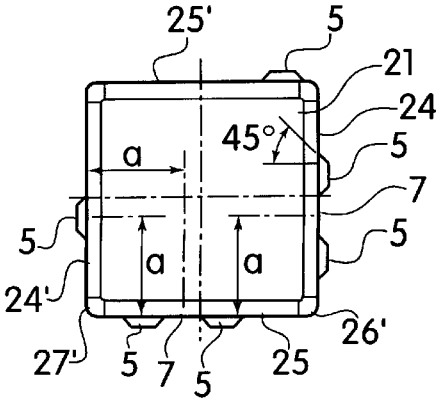
FIG. 16 shows a top view of a square paving block.
Figure 17:
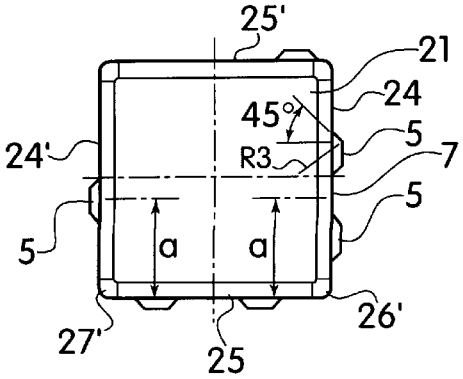
FIG. 17 shows a top view of a paving block of FIG. 16 in a modified embodiment.

The stone body 21, which is square in its base surface, of FIG. 16 has two extensions 5 each on two adjoining side surfaces 24, 25, for forming grooves 7, while the two other side surfaces, 24', 25', each have a single extension 5. The extension of one side surface 24' is flush with groove 7, while the extension 5 of the other side surface 25' is arranged in an offset manner to the extension 5 of the opposite side surface 25. In the square paving block of FIG. 17, one side surface 24 has two extensions 5 for forming a groove 7, while the other side surfaces 24', 25, 25', always carry a single extension 5. One extension 5 of side surface 24' is aligned with groove 7 and the extensions of the two other side surfaces 25, 25' are aligned with each other in an offset manner.

While several embodiments of the present invention have been shown and described, it is to be understood that many changes and modifications may be made thereunto without departing from the spirit and scope of the invention as defined in the appended claims.

What is claimed is:

1. A combination of paving stones forming a laid composite with each paving stone made of concrete comprising (a) the body (1) of said stone having a right-angled shape formed by three squares (2, 3, 4) of the same size, and upright plane side surfaces (6, 13, 13', 10, 10') with strip-like attachments (5) arranged on said side surface;

(b) the side surfaces (6) of stone body (1) each have two strip-like attachments (5) with a spacing "b" from each other, said attachments forming grooves (7) with spacing "a" between a center plane of grooves (7) and corner edges (8, 9'), and an attachment (5) with spacing "a" from corner edge (9) and corner edge (8), respectively, whereby spacing "a" of the attachments (5) nearer to corner edges (8, 9') corresponds with a distance of the center plane of grooves (7) from corner edge (8) and corner edge (9') respectively;

(c) the faces (13, 13') with spacing "b" from each other each have two attachments (5) forming a groove (7), whereby the attachments (5) of face (13) are arranged with spacing "a" of corner edge (9) from the center plane of grooves (7), and the attachments (5) of face (13') are formed with spacing "a" of corner edge (12) from the center plane of grooves (7);

(d) side surfaces (10, 10') each have an attachment (5), whereby attachment (5) of side surface (10) is arranged with spacing "a" from corner edge (12) and attachment (5) of side surface (10') with spacing "a" from corner edge (11); and (b) within said laid composite, attachments (5) of stone bodies (1) form tongue-and-groove hook-ups with attachments (5) of identical adjacent stone bodies (1) to prevent tilting of the stone bodies, said attachments (5) form spacing elements abutting on adjacent stone bodies (1), and said attachments (5) form groove-like passages next to the attachments between the side surfaces (6, 13, 13', 10, 10') of the adjacent stone bodies.

2. The combination of paving stones according to claim 1 wherein side surfaces (6) of stone body (1) each have an attachment (5), forming grooves (7) with spacing "a" between the center planes of grooves (7) and corner edges (8, 9) next to each other and with a spacing "b" from each other, and each has an attachment (5) with spacing "a" from corner edges (8, 9') of the same side surfaces, whereas side surface (10) has an attachment (5) with spacing "a" from corner edge (9) and side surface (10') has an attachment (5) with a spacing from corner edge (12), and face (13) has two attachments (5) with spacing "b" from each other and with spacing "a" of a common center plane from corner edge (9'), and face (13') has one single attachment (5) with spacing "a" from corner edge (9).

3. The combination of paving stones according to claim 2, wherein side surface (10') of stone body (1) has attachments (5) with spacing "b" from each other and with spacing "a" of a common center plane from corner edge (12), said attachments forming a groove; and an attachment (5) is arranged on face (13') with spacing "a" from corner edge (9).

4. The combination of paving stones according to claim 3, wherein side surface (10') has an attachment (5) with spacing "a" from corner edge (11); face (13) has two attachments (5) with spacing "b" from each other and with spacing "a" from corner edge (9'), said attachments forming a groove (7); and face (13') has an attachment (5) with spacing "a" from corner edge (9).

5. The combination of paving stones according to claim 3, wherein side surface (10) has an attachment (5) with spacing "a" from corner edge (9"); face (13) has two attachments (5) with spacing "b" from each other and with spacing "a" from corner edge (9'), said attachments forming a groove (7); and face (13') has an attachment (5) with spacing "a" from corner edge (9).

6. The combination of paving stones according to claim 1, wherein side surface (6) has two attachments (5) with spacing "b" from each other and with spacing "a" of a common center plane from corner edges (8, 9), and an attachment (5) with spacing "a" from corner edges (8) and (9'), respectively; faces (13, 13') each have an attachment (5), whereby attachment (5) of face (13') is formed with spacing "a" from corner edge (9); and that on face 10', two attachments are associated with corner edge (12) with spacing "a" from the common center plane and with spacing "b" from each other.

7. The combination of paving stones according to claim 1, wherein a number of stone bodies (1) form a rectangular laying set as a unit with outside dimensions of 40 by 60 cm; and the laying set (15) is mechanically seizable and layable.

8. The combination of paving stones according to claim 1, wherein a number of stone bodies (1) form a rectangular laying set (17) as a unit with outside dimensions of 20 by 40 cm; and the laying sets (17) with the same dimensions jointly form a laying set with dimensions of at least 40, 60, 80 cm, by 40 cm, said set being simultaneously seizable and layable.

* * * * *

UNITED STATES PATENT AND TRADEMARK OFFICE

CERTIFICATE OF CORRECTION

PATENT NO. : 6,055,784
DATED : May 2, 2000
INVENTOR(S) : Peter GEIGER

It is certified that error appears in the above-identified patent and that said Letters Patent is hereby corrected as shown below:

In column 5, (claim 1), line 43, change "(b)" to --(e)--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*